US005205559A

United States Patent [19]

Plopper

[11] Patent Number: 5,205,559

[45] Date of Patent: Apr. 27, 1993

[54] PUTTING PRACTICE TARGET

[76] Inventor: Raymond P. Plopper, N. 6607 Ash, Suite 1000, Spokane, Wash. 99208

[21] Appl. No.: 848,112

[22] Filed: Mar. 9, 1992

[51] Int. Cl.[5] ..... A63B 69/36

[52] U.S. Cl. ..... 273/177 R; 273/34 B; 273/127 B

[58] Field of Search ..... 273/178 R, 178 A, 178 B, 273/177 R, 177 A, 34 B, 176 AB, 179 C, 177 B, 181 A, 127 B

[56] References Cited

U.S. PATENT DOCUMENTS

| | | | |
|---|---|---|---|
| 898,530 | 9/1908 | Treadwell | 273/177 A |
| 1,558,767 | 10/1925 | Smith | 273/34 B |
| 1,676,975 | 7/1928 | Anderson et al. | 273/177 R |
| 1,979,584 | 11/1934 | Thompson | 273/162 X |
| 2,459,559 | 1/1949 | Watkins | 273/177 R |
| 3,424,464 | 1/1969 | Greenhouse | 273/178 |
| 3,464,704 | 9/1969 | Nelson | 273/176 |
| 3,659,856 | 5/1972 | Fatur | 273/177 R |
| 3,837,653 | 9/1974 | Fox et al. | 273/34 R X |
| 4,280,698 | 7/1981 | Troiano | 273/34 B |
| 4,521,018 | 6/1985 | Cotchonis | 273/178 R |
| 4,660,834 | 4/1987 | Carrigan | 273/176 AB |
| 4,900,023 | 2/1990 | Gelina | 273/34 B |
| 5,087,046 | 2/1992 | Mauch | 273/178 R |

FOREIGN PATENT DOCUMENTS

| | | | |
|---|---|---|---|
| 220377 | 7/1924 | United Kingdom | 273/34 B |

OTHER PUBLICATIONS

"Golf Digest" Nov. 1984, p. 89.

*Primary Examiner*—George J. Marlo
*Attorney, Agent, or Firm*—Wells, St. John, Roberts, Gregory & Matkin

[57] ABSTRACT

The specification discloses a reducer for a golf hole on a putting surface for practicing putting on a putting surface which forms a circular peripheral lip around the golf hole. The reducer comprises a cover and retaining means for positioning the cover over the golf hole. The cover has a U-shaped cutout has a width which is smaller than the golf hole and larger than the golf ball. The retaining means positions the cover over the golf hole to define a reduced diameter practice hole within the golf hole, the practice hole being defined by the U-shaped cutout and an exposed a front segment of the golf hole peripheral lip beneath the U-shaped cutout. The cover and U-shaped cutout are thus positioned to allow a golf ball to roll over the front segment of the golf hole peripheral lip into the practice hole without contacting the cover. The cover has a non-circular size and shape to extend radially beyond the circular peripheral lip of the golf hole to effectively mask the diameter and circular shape of the golf hole.

24 Claims, 6 Drawing Sheets

PUTTING PRACTICE TARGET

TECHNICAL FIELD

This invention relates to putting practice devices for reducing the width of a golf hole during practice.

BACKGROUND OF THE INVENTION

Putting practice plays an important role in improving a golfer's overall score. Accordingly, golfers spend a significant amount of time on practice greens.

A practice green usually contains a number of golf holes on a smooth, closely mown putting surface. Each golf hole has a circular shape of regulation diameter and is made by inserting a putting cup into the ground slightly below the putting surface. A golf ball, having a diameter considerably smaller than the golf hole diameter, falls easily into the golf hole even when it is not directed to the hole's center.

Practice devices exist to improve a golfer's putting accuracy. Some of such devices provide a reduced-diameter putting hole for practicing. Such devices generally consist of a bushing-like insert with an outer diameter about equal to the golf hole diameter and a concentric inner diameter somewhat smaller than the golf hole diameter. Such devices are inserted within the practice cup to effectively reduce the diameter of the golf hole for practice purposes. For examples of such devices, refer to U.S. Pat. Nos. 4,280,698 to Troiano and 4,900,023 to Gelina.

The invention described below is a device for placing over a golf hole to create a reduced-diameter practice hole while providing important advantages over the prior art devices mentioned above.

BRIEF DESCRIPTION OF THE DRAWINGS

Preferred embodiments of the invention are described below with reference to the accompanying drawings, in which.

DETAILED DESCRIPTION OF THE PREFERRED EMBODIMENTS

This disclosure of the invention is submitted in furtherance of the constitutional purposes of the U.S. Patent Laws "to promote the progress of science and useful arts." U.S. Constitution, Article 1, Section 8.

In accordance with one aspect of the invention, a reducer for a golf hole on a putting surface for practicing putting comprises:

a cover for positioning over the golf hole, the cover having a U-shaped cutout for exposing a front segment of the golf hole peripheral lip, the U-shaped cutout having an open cross dimension which is smaller than the golf hole diameter and larger than the golf ball diameter, the cover being sized and shaped to extend radially beyond the circular peripheral lip of the golf hole to effectively mask the diameter of the golf hole except for the exposed front segment of the peripheral lip; and retaining means for positioning the cover relative to the golf hole to form a reduced width practice hole within the peripheral lip of the golf hole, the practice hole being defined by the U-shaped cutout and by the exposed front segment of the golf hole peripheral lip, the U-shaped cutout being positioned to allow a golf ball to roll over the front segment of the golf hole peripheral lip into the practice hole without contacting the cover when the cover is positioned by the retaining means.

In accordance with another aspect of the invention, a reducer for a golf hole on a putting surface for practicing putting comprises:

a cover having a generally U-shaped cutout, the U-shaped cutout having an open cross dimension which is smaller than the golf hole diameter and larger than the golf ball diameter; and retaining means for positioning the cover relative to the golf hole to form a reduced width practice hole within the peripheral lip of the golf hole, the practice hole being defined by the U-shaped cutout and by a front segment of the golf hole peripheral lip, the U-shaped cutout being positioned to allow a golf ball to roll over the front segment of the golf hole peripheral lip into the practice hole without contacting the cover when the cover is positioned by the retaining means.

Figure 1:
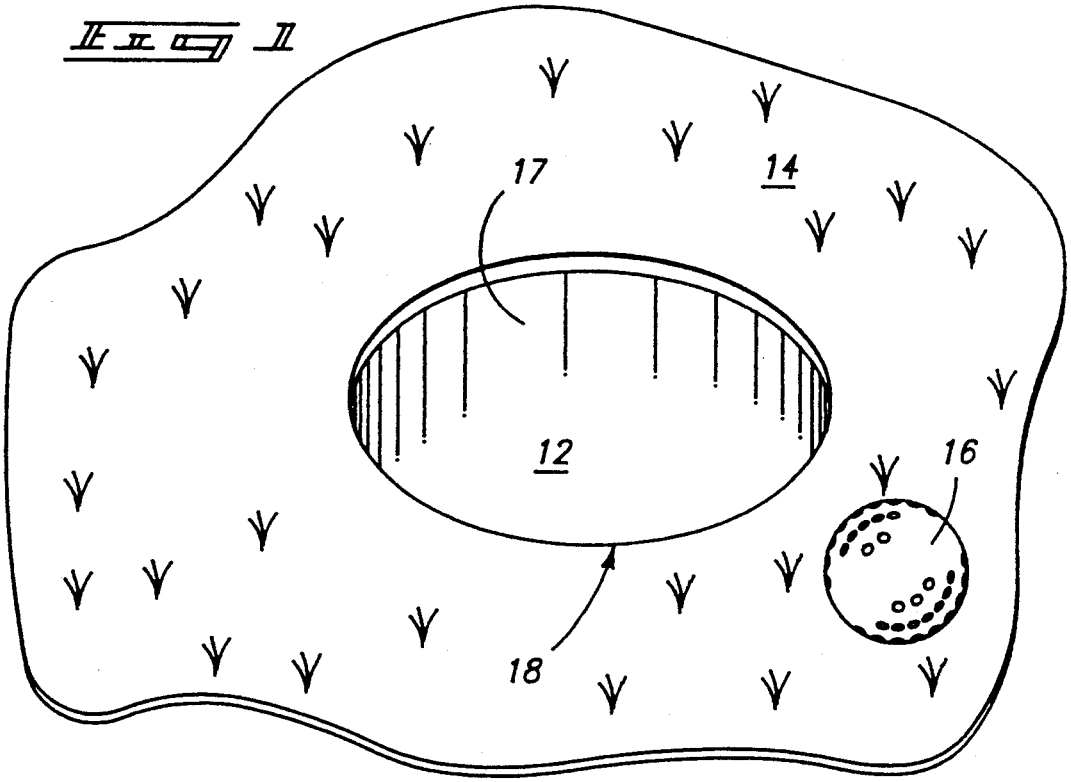
FIG. 1 is a perspective view of a golf hole in a putting surface.

FIG. 1 shows a golf hole 12 in a putting surface 14 for practicing putting with a golf ball 16 of a selected regulation diameter. Golf hole 12 has a circular shape and a selected regulation diameter, defined by a putting cup 17, which is considerably larger than the diameter of golf ball 16. Putting surface 14 forms a circular peripheral lip 18 around golf hole 12.

Figure 2:
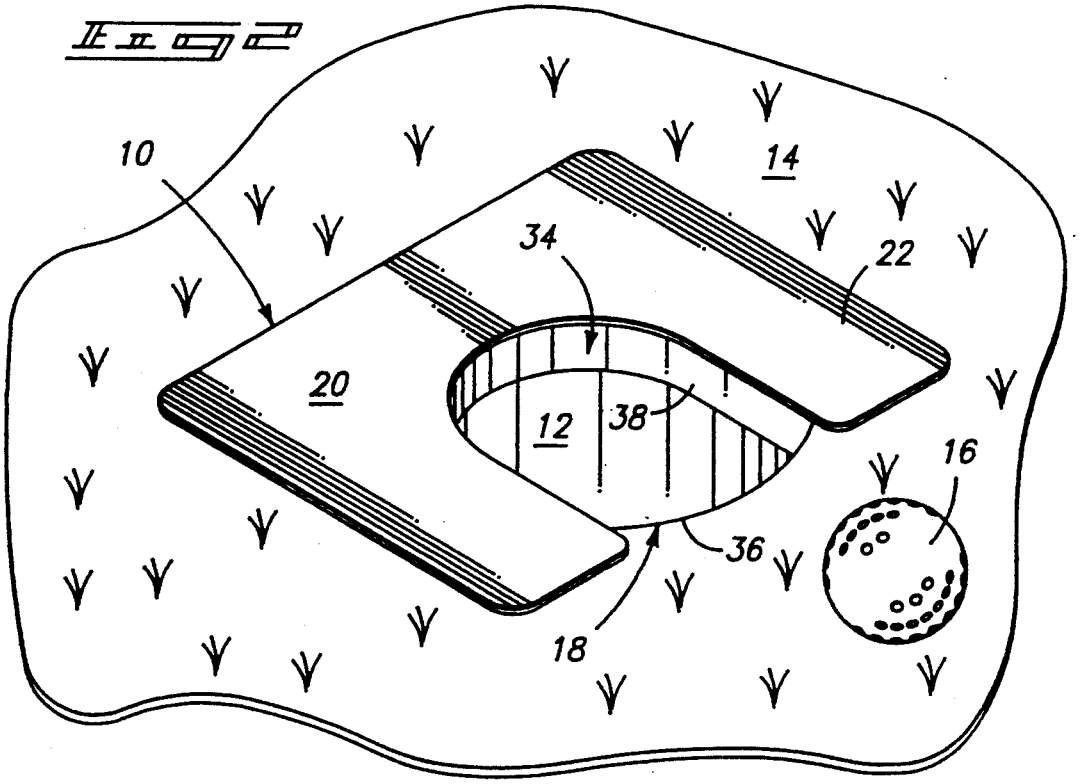
FIG. 2 is a perspective view of a preferred embodiment of a golf hole reducer in accordance with this invention.
Figure 3:
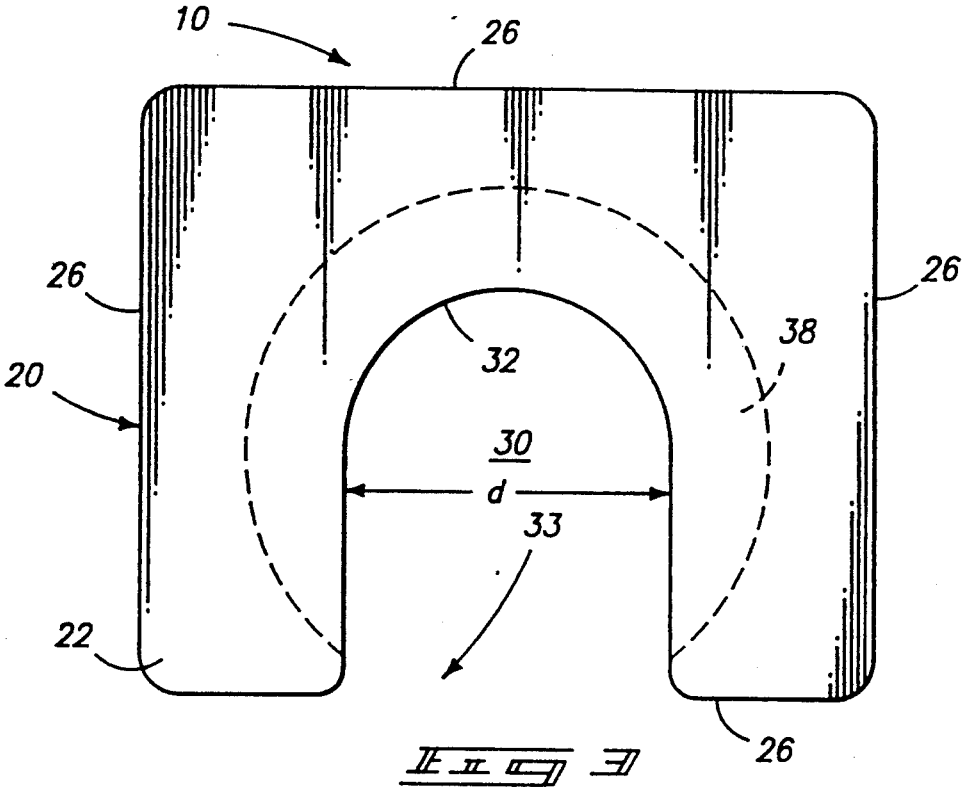
FIG. 3 is a top view of the golf hole reducer of FIG. 2.
Figure 4:
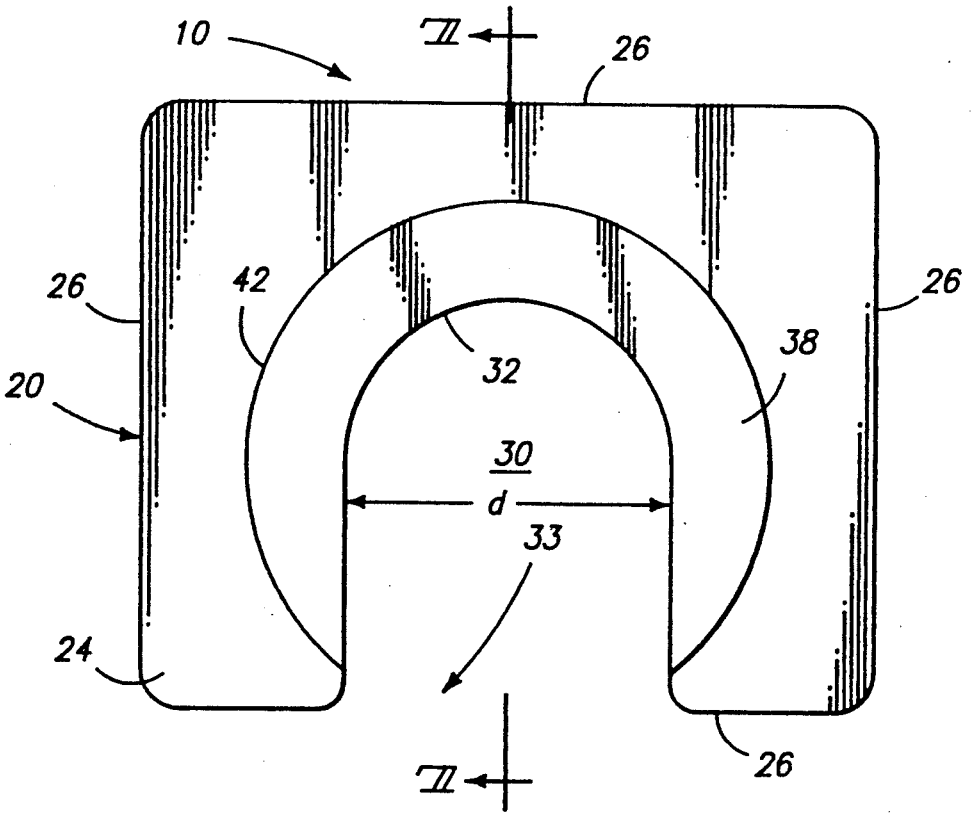
FIG. 4 is a bottom view of the golf hole reducer of FIG. 2.
Figure 5:
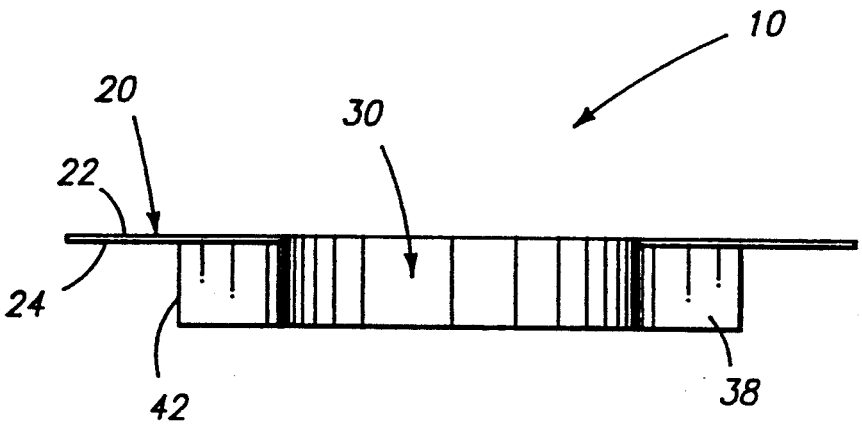
FIG. 5 is a front elevational view of the golf hole reducer of FIG. 2.
Figure 6:
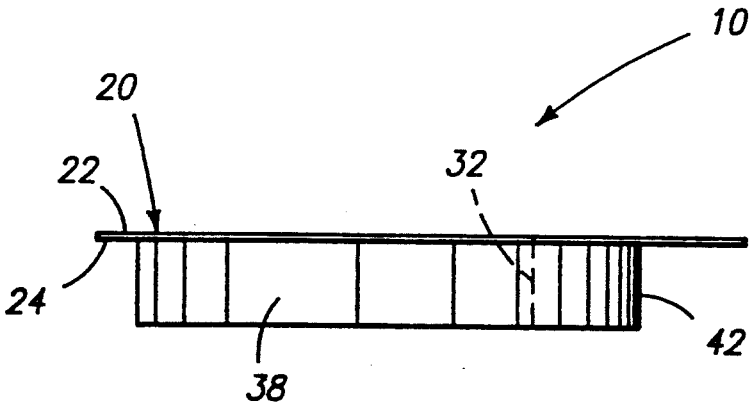
FIG. 6 is a side elevational view of the golf hole reducer of FIG. 2.
Figure 7:
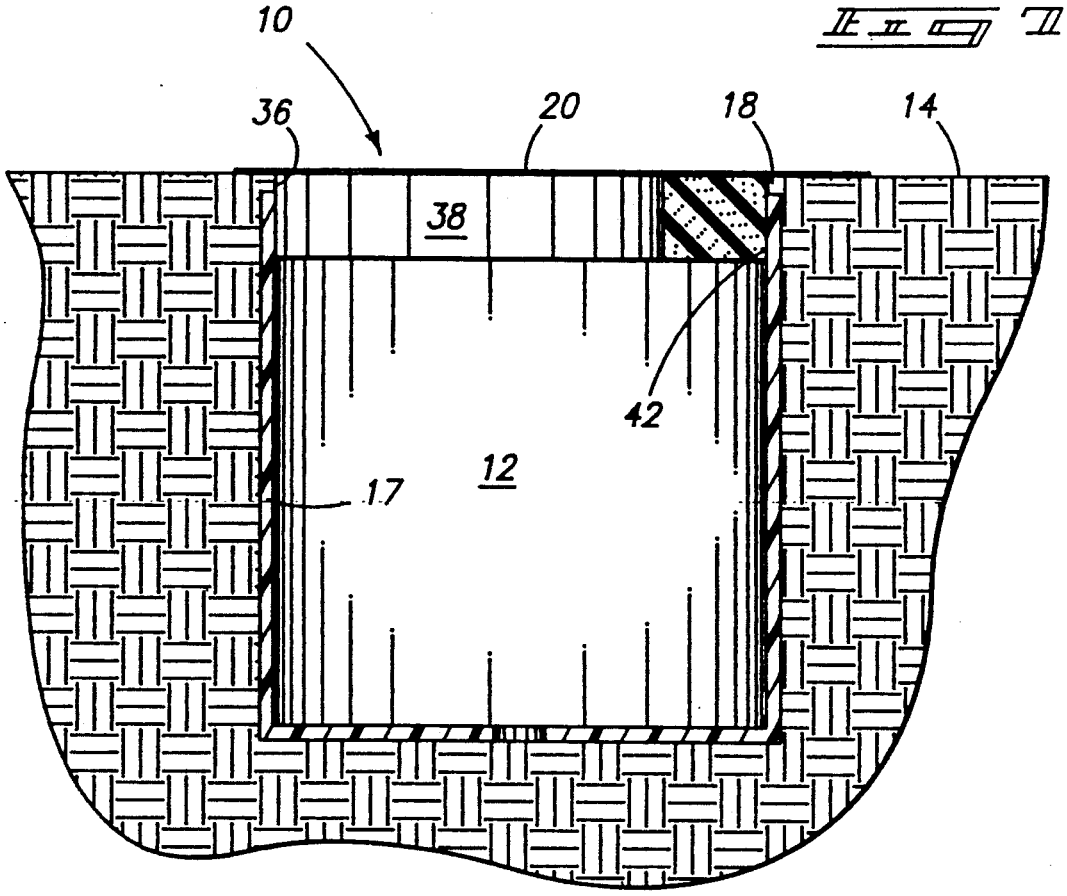
FIG. 7 is a cross-sectional view of the golf hole reducer of FIG. 2 taken along line 7—7 of FIG. 4, and showing the golf hole reducer positioned over a golf hole.

FIGS. 2–7 show a preferred embodiment of a reducer for a golf hole in accordance with this invention. The reducer is generally designated by the reference numeral 10. In FIG. 2, reducer 10 is shown positioned over golf hole 12.

Referring to FIGS. 1–7, golf hole reducer 10 comprises a cover or thin sheet 20 for positioning over golf hole 12. Cover 20 has upper and lower opposed planar surfaces 22 and 24. It has lateral dimensions greater than the diameter of golf hole 12 to extend radially beyond circular peripheral lip 18 when positioned to overlie golf hole 12.

Cover 20 can be constructed from any durable and light-weight material such as polyethylene. Cover 20 is preferably as thin as possible so that it does not significantly interfere with or alter the course of a golf ball if and when a golf ball rolls over cover 20. However, cover 20 is also preferably strong enough to resist bending beneath the weight of golf ball 16. When cover 20 is made from polyethylene, a thickness of 0.030 inches has been found to be optimum.

Cover 20 is sized and shaped to extend radially beyond circular peripheral lip 18 of golf hole 12. In addition, cover 20 has a non-circular shape to effectively mask the diameter and circular shape of golf hole 12. This non-circular shape is preferably square, rectangular, or some other shape to contrast with the circular shape of golf hole 12. Cover 20 has four lateral sides or edges 26. A U-shaped cutout 30 is formed through cover 20. U-shaped cutout 30 extends from a base end 32 near the center of cover 20 to an open end 33 at one of edges 26. U-shaped cutout 30 has an open cross dimension d (shown in FIGS. 3 and 4) which is smaller than the golf hole diameter and larger than the golf ball diameter. A cross dimension of about two and one half inches is preferred when reducer 10 is used with standard golf balls and holes.

Reducer 10 has retaining means for positioning cover 20 relative to golf hole 12 to form a reduced width practice hole 34 within golf hole peripheral lip 18. When cover 20 is so positioned, cover 20 covers peripheral lip 18 of golf hole 12 except for an exposed front segment 36 beneath open end 33 of U-shaped cutout 30. Practice hole 34 is therefore defined by U-shaped cutout 30 and by exposed front segment 36 of golf hole peripheral lip 18.

The retaining means comprises a disk-shaped member 38 formed on lower planar surface 24 of cover 20 beneath U-shaped cutout 30. Disk-shaped member 38 has a U-shaped cutout corresponding to U-shaped cutout 30 of cover 20, having an open end which coincides with open end 33 of cover cutout 30. Disk-shaped member 38 has a periphery which forms a circular positioning shoulder 42 extending downward from lower planar surface 24 of cover 20. Disk-shaped member 38 and positioning shoulder 42 are complementary in diameter to golf hole 12, fitting loosely within golf hole 12 yet laterally positioning and retaining reducer 10 over golf hole 12.

Disk-shaped member 38 is preferably a lightweight material such as foam rubber, but could also be formed integrally with and of the same material as cover 20.

The shape, size, and position of cover 20 when positioned over golf hole 12 provide a uniquely effective practice target. The outer dimensions of cover 20 effectively mask the diameter and circular shape of golf hole 12 except for exposed front segment 36 of peripheral lip 18. When practicing with a standard hole, such as hole 12 of FIG. 1, a golfer becomes accustomed to the size and shape of the hole. With prior art practice reducers, the size and shape of the standard hole remain discernable to the golfer who is then unable to completely disregard them.

In contrast, as shown in FIG. 2, the non-circular outer dimensions of cover 20 completely obscure the size and shape of standard golf hole 12 from the golfer's vision. Reduced width practice hole 34 is all that remains discernable. The preferred embodiment reducer of this invention therefore not only provides a reduced diameter practice hole, but causes the golfer to forget the size and shape of the standard hole while practicing. Accordingly after practicing, the standard golf hole will appear much larger and more receptive to a golf ball in comparison, inspiring a confident and hopefully more accurate putting stroke.

In addition, disk-shaped member 38 positions the U-shaped cutout of cover 20 to expose front segment 36 of peripheral lip 18, thereby allowing golf ball 16 to roll over front segment 36 of peripheral lip 18 into practice hole 34 without contacting cover 20. The ball therefore travels only over natural putting surface, in contrast to prior art devices in which the ball must first pass over the reducer itself before falling into the practice hole. Being able to putt over a natural putting surface results in more effective and realistic practice.

Another advantage of golf hole reducer 10 is that it is very simple to position and install in or over a golf hole. While previously known golf hole reducers rely on friction between a hole insert and the inner walls of a putting cup for vertical support, reducer 10 is vertically supported by the portions of cover 20 which extend over putting surface 14. Positioning shoulder 42 fits in golf hole 12 without interference or friction so that reducer 10 can be easily positioned over golf hole 12. Further ease of placement can be achieved by bevelling disk-shaped member 38 so that its diameter decreases away from cover 20.

FIGS. 8–12 show additional embodiments of the invention. Since the additional embodiments are in most respects identical to the embodiment already described with reference to FIGS. 2–7, common reference numerals have been used where appropriate, with the addition of a suffix in the embodiments of FIGS. 8–12. In the following discussion, only those elements or features which differ from the embodiment of FIGS. 2–7 will be described.

Figure 8:
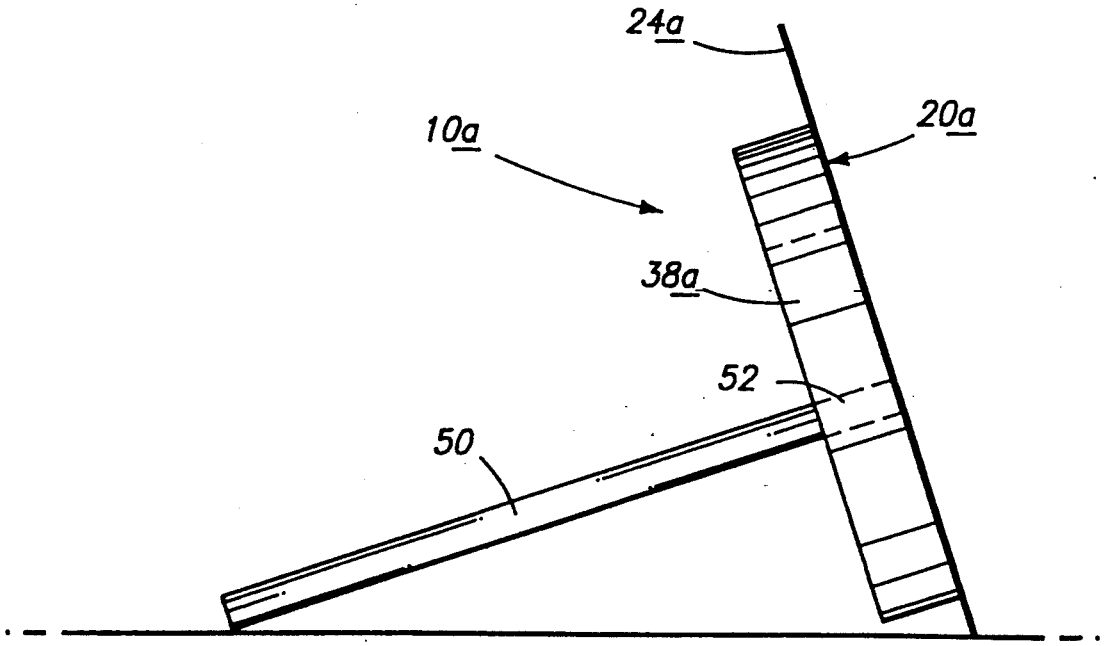
FIG. 8 is a side elevational view of a second preferred embodiment of a golf hole reducer in accordance with this invention.
Figure 9:
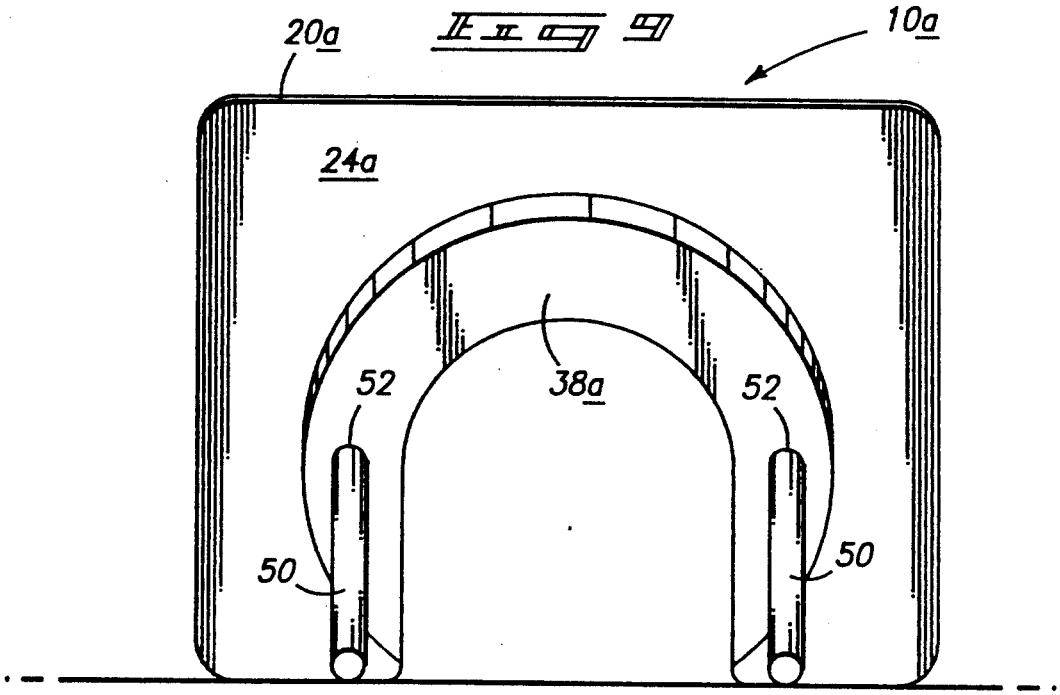
FIG. 9 is a rear elevational view of the golf hole reducer of FIG. 8.

FIGS. 8 and 9 show a second embodiment of a golf hole reducer 10*a*. Reducer 10*a* includes means for standing golf hole reducer 10*a* on end. Reducer 10*a* is identical to reducer 10 of FIGS. 2–7 except for the addition of at least one and preferably two legs 50. Legs 50 are removably attached to cover 20*a* to extend from lower planar surface 24*a* of cover 20*a*. Specifically, holes 52 are formed in disk-shaped member 38*a* to receive legs 50. Legs 50, when received by holes 52, have a position, orientation, and length for standing reducer 10*a* on end. Legs 50 are positioned on either side of U-shaped cutout 30*a* to straddle U-shaped cutout 30*a*. Standing reducer 10*a* on end allows it to be used on carpet or in other locations where golf holes are not present. When propped on its end by legs 50, reducer 10*a* forms an upright U-shaped gate which can be used as a target for practicing putting without a golf hole. Legs 50 can be removed to use golf hole reducer 10*a* over a golf hole as described with reference to FIGS. 2–7. Legs 50 are preferably formed from a light-weight plastic, although wooden dowels cut to appropriate lengths can also form legs 50.

Figure 10:
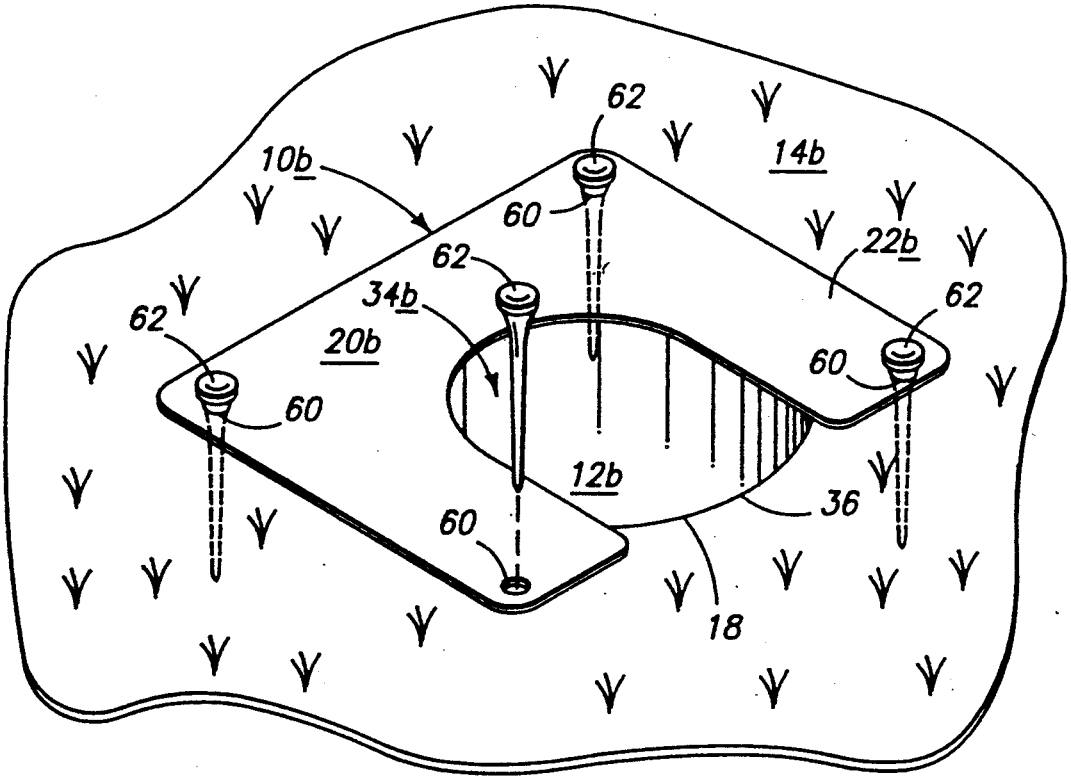
FIG. 10 is a perspective view of a third preferred embodiment of a golf hole reducer in accordance with this invention.

FIG. 10 shows a third embodiment of a golf hole reducer 10*b*. Reducer 10*b* includes a cover 20*b* which is identical to cover 20 of FIGS. 2–7. However, reducer 10*b* does not include a disk-shaped member or circular shoulder for laterally retaining reducer 10*b* over golf hole 12*b*. Rather, reducer 10*b* has retaining means comprising a plurality of retaining holes 60 extending through cover 20*b* over putting surface 14*b*. Golf tees or other removeable pegs 62 are received through cover retaining holes 60 for placement into putting surface 14b for retaining reducer 10b over golf hole 12b. This embodiment is more compact than the embodiments previously described, but is somewhat less convenient in that it requires more effort to position cover 20b.

The holes and removeable pegs illustrated in FIG. 10 could alternatively be replaced by a plurality of pegs formed integrally with cover 20b to extend downwardly from cover 20b.

Figure 11:
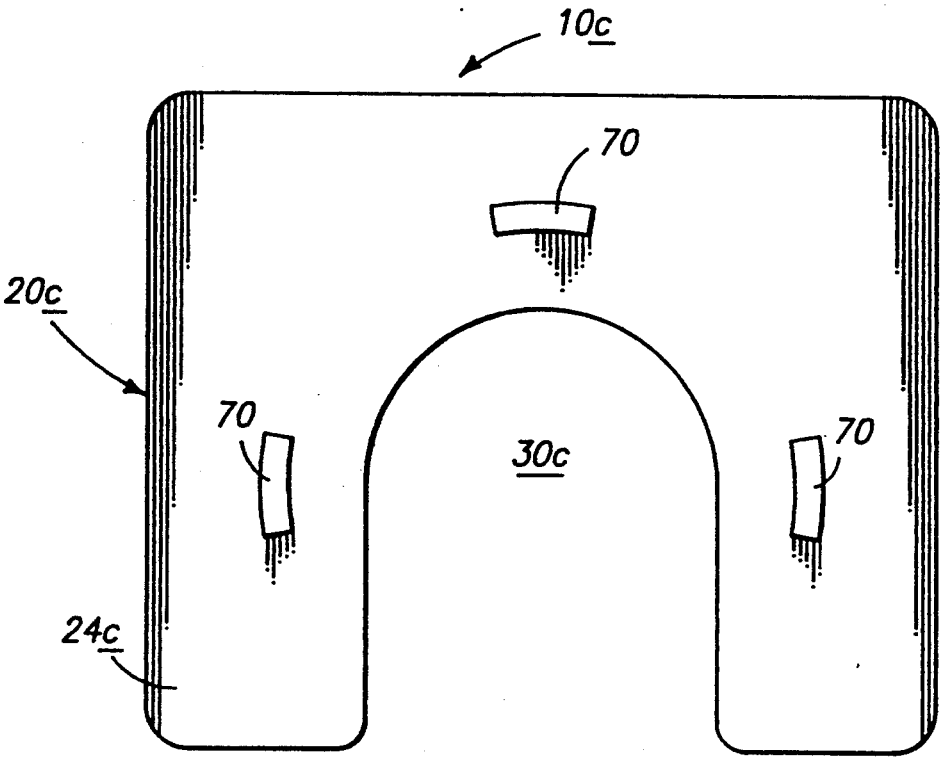
FIG. 11 is a bottom view of a fourth preferred embodiment of a golf hole reducer in accordance with this invention.
Figure 12:
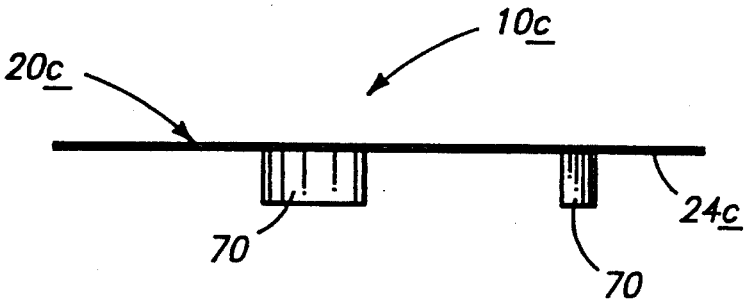
FIG. 12 is a side elevational view of the golf hole reducer of FIG. 11.

FIGS. 11 and 12 show a third embodiment of a golf hole reducer 10c. Reducer 10c includes a cover 20c which is identical to cover 20 of FIGS. 2–7. However, disk-shaped member 38 has been replaced by a plurality of guide members 70 extending downwardly from lower surface 24c of cover 20c. Guide members 70 have an arcuate shape and are positioned to loosely engage the golf hole about its peripheral lip 18c to laterally position and retain reducer 10c over the golf hole. In the preferred embodiment shown, three guide members 70 are positioned beneath cover 20c. Guide members 70 are preferably formed from light-weight plastic or foam and affixed to lower surface 24c of cover 20c. Alternatively, guide members 70 can be integrally formed with and of the same material as cover 20c.

In compliance with the statute, the invention has been described in language more or less specific as to structural features. It is to be understood, however, that the invention is not limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A reducer for a golf hole on a putting surface for practicing putting with a golf ball of a selected diameter, the golf hole having a circular shape and a size defined by a selected diameter, the putting surface forming a circular peripheral lip around the golf hole, the reducer comprising:

a cover for positioning over the golf hole, the cover having a U-shaped cutout for exposing a front segment of the golf hole peripheral lip, the U-shaped cutout having opposing sides forming an open cross dimension which is smaller than the golf hole diameter and larger than the golf ball diameter, the cover being sized and shaped to extend radially beyond the circular peripheral lip of the golf hole to effectively mask the size and shape of the golf hole and to extend to the front segment of the peripheral lip of the golf hole; and means for retaining the cover in position over the golf hole and restraining lateral movement thereof while the opposing sides of said U-shaped cutout are positioned inwardly of the peripheral lip of the golf hole so that a practice hole is defined by the U-shaped cutout and by the exposed front segment of the golf hole peripheral lip, the U-shaped cutout being positioned to allow a golf ball to roll over the front segment of the golf hole peripheral lip between said opposing sides into the practice hole.

2. The golf hole reducer of claim 1 wherein the retaining means comprises a circular shoulder extending downward from the cover, the circular shoulder being complementary in diameter to the golf hole.

3. The golf hole reducer of claim 1 wherein the retaining means comprises a plurality of retaining holes extending through the cover to receive pegs therethrough for placement into the putting surface.

4. The golf hole reducer of claim 1 wherein the retaining means comprises a plurality of guide members extending downwardly from the cover, the guide members being positioned for engaging the golf hole peripheral lip to laterally position and retain the reducer over the golf hole.

5. The golf hole reducer of claim 1 wherein the cover comprises a thin sheet to overlie the golf hole without significantly interfering with the golf ball as it rolls over the thin sheet.

6. The golf hole reducer of claim 1 further comprising means for standing the reducer on end to form an upright U-shaped gate for practicing putting without the golf hole.

7. The golf hole reducer of claim 1 wherein the cover has a lower surface, the golf hole reducer further comprising at least one leg for removable attachment to the cover to extend from the lower surface of the cover, the leg having a position, orientation, and length for standing the reducer on end to form an upright U-shaped gate for practicing putting without the golf hole.

8. A reducer for a golf hole on a putting surface for practicing putting with a golf ball, the golf hole and golf ball having selected diameters, the putting surface forming a circular peripheral lip around the golf hole, the reducer comprising:

a cover having a generally U-shaped cutout, the U-shaped cutout having opposing sides forming an open cross dimension which is smaller than the golf hole diameter and larger than the golf ball diameter, the cover being sized and shaped to extend radially beyond the circular peripheral lip of the golf hole to effectively mask the size and shape of the golf hole and to extend to the front segment of the peripheral lip of the golf hole; and means for retaining the cover in position over the golf hole and restraining lateral movement thereof while the opposing sides of said U-shaped cutout are positioned inwardly of the peripheral lip of the golf hole so that a practice hole is defined by the U-shaped cutout and by a front segment of the golf hole peripheral lip, the U-shaped cutout being positioned to allow a golf ball to roll over the front segment of the golf hole peripheral lip between said opposing sides into the practice hole.

9. The golf hole reducer of claim 8 wherein the retaining means comprises a circular shoulder extending downward from the cover, the circular shoulder being complementary in diameter to the golf hole.

10. The golf hole reducer of claim 8 wherein the retaining means comprises a plurality of retaining holes extending through the cover to receive pegs therethrough for placement into the putting surface.

11. The golf hole reducer of claim 8 wherein the retaining means comprises a plurality of guide members extending downwardly from the cover, the guide members being positioned for engaging the golf hole peripheral lip to laterally position and retain the reducer over the golf hole.

12. The golf hole reducer of claim 8 wherein the cover comprises a thin sheet to overlie the golf hole without significantly interfering with the golf ball as it rolls over the thin sheet.

13. The golf hole reducer of claim 8 further comprising means for standing the reducer on end to form an upright U-shaped gate for practicing putting without the golf hole.

14. The golf hole reducer of claim 8 wherein the cover has a lower surface, the golf hole reducer further comprising at least one leg for removable attachment to the cover to extend from the lower surface of the cover, the leg having a position, orientation, and length for standing the reducer on end to form an upright U-shaped gate for practicing putting without the golf hole.

15. A reducer for a golf hole on a putting surface for practicing putting with a golf ball of a selected diameter, the golf hole having a circular shape and size defined by a selected diameter, the putting surface forming a circular peripheral lip around the golf hole, the reducer comprising:

a cover for positioning over the golf hole, the cover having a U-shaped cutout for exposing a front segment of the golf hole peripheral lip, the U-shaped cutout having opposing sides forming an open cross dimension which is smaller than the golf hole diameter and larger than the golf ball diameter, the cover having a non-circular size and shape to extend radially beyond the circular peripheral lip of the golf hole to cover the golf hole and effectively mask the size and shape of the golf hole; and means for retaining the cover in position over the golf hole and restraining lateral movement thereof while the opposing sides of said U-shaped cutout are positioned inwardly of the peripheral lip of the golf hole so that a practice hole is defined by the U-shaped cutout and by the exposed front segment of the golf hole peripheral lip, the U-shaped cutout being positioned to allow a golf ball to roll over the front segment of the golf hole peripheral lip into the practice hole.

16. The golf hole reducer of claim 15 wherein the retaining means comprises a circular shoulder extending downward from the cover, the circular shoulder being complementary in diameter to the golf hole.

17. The golf hole reducer of claim 15 wherein the retaining means comprises a plurality of retaining holes extending through the cover to receive pegs therethrough for placement into the putting surface.

18. The golf hole reducer of claim 15 wherein the retaining means comprises a plurality of guide members extending downwardly from the cover, the guide members being positioned for engaging the golf hole peripheral lip to laterally position and retain the reducer over the golf hole.

19. The golf hole reducer of claim 15 wherein the cover comprises a thin sheet to overlie the golf hole with significantly interfering with the golf ball as it rolls over the thin sheet.

20. The golf hole reducer of claim 15 further comprising means for standing the reducer on end to form an upright U-shaped gate for practicing putting without the golf hole.

21. The golf hole reducer of claim 15 wherein the cover has a lower surface, the golf hole reducer further comprising at least one leg for removable attachment to the cover to extend from the lower surface of the cover, the leg having a position, orientation, and length for standing the reducer on end to form an upright U-shaped gate for practicing putting without the golf hole.

22. A reducer for a golf hole on a putting surface for practicing putting with a golf ball of a selected diameter, the golf hole having a circular shape and size defined by a selected diameter, the putting surface forming a circular peripheral lip around the golf hole, the reducer comprising:

a thin cover sheet having upper and lower opposed planar surfaces, the cover sheet having lateral dimensions greater than the golf hole diameter to extend radially beyond the circular peripheral lip of the golf hole when positioned over the golf hole, the cover sheet having a non-circular shape to mask the size and shape of the golf hole when positioned over the golf hole, the cover sheet having a U-shaped cutout having opposing sides forming an open cross dimension which is smaller than the golf hole diameter and larger than the golf ball diameter;

a positioning shoulder extending downward from the lower planar surface of the cover sheet, the positioning shoulder being adapted to fit loosely within the peripheral lip of the golf hole and elongated sufficiently to position and restrain lateral movement of the reducer over the golf hole when positioned thereabove with the opposing sides of said cutout positioned inwardly of the peripheral lip of the golf hole; and the cover when positioned over the golf hole by the positioning shoulder forming a reduced width practice hole within the peripheral lip of the golf hole, the practice hole being defined by the U-shaped cutout and by an exposed front segment of the golf hole peripheral lip, the U-shaped cutout allowing a golf ball to roll over the front segment of the golf hole peripheral lip into the practice hole without contacting the cover.

23. The golf hole reducer of claim 22 further comprising means for standing the reducer on end to form an upright U-shaped gate for practicing putting without the golf hole.

24. The golf hole reducer of claim 22 wherein the cover has a lower surface, the golf hole reducer further comprising at least one leg for removable attachment to the cover to extend from the lower surface of the cover, the leg having a position, orientation, and length for standing the reducer on end to form an upright U-shaped gate for practicing putting without the golf hole.

* * * * *